US005432988A

United States Patent [19]

Woo

[11] Patent Number: 5,432,988

[45] Date of Patent: Jul. 18, 1995

[54] METHOD FOR SETTING GEM STONE IN SEMI-PRECIOUS STONE

[75] Inventor: Chong C. Woo, Seoul, Rep. of Korea

[73] Assignee: Pyoung Su Kim, Seoul, Rep. of Korea

[21] Appl. No.: 291,720

[22] Filed: Aug. 17, 1994

[30] Foreign Application Priority Data

Feb. 14, 1994 [KR] Rep. of Korea ..... 1994-2543

[51] Int. Cl.[6] ..... A44C 17/02; B21F 43/00

[52] U.S. Cl. ..... 29/10; 29/160.6; 63/26; 156/252

[58] Field of Search ..... 29/10, 160.6; 63/26, 63/27, 28; 156/91, 252

[56] References Cited

U.S. PATENT DOCUMENTS

| | | | |
|---|---|---|---|
| 3,261,072 | 7/1966 | Stanley | 29/160.6 |
| 4,936,115 | 6/1990 | Mesica | 63/26 |

FOREIGN PATENT DOCUMENTS

| | | | |
|---|---|---|---|
| 576493 | 1/1924 | France | 29/160.6 |
| 642585 | 10/1927 | France | 63/26 |
| 260123 | 7/1949 | Switzerland | 63/26 |

*Primary Examiner*—P. W. Echols

*Attorney, Agent, or Firm*—Merchant, Gould, Smith, Edell, Welter & Schmidt

[57] ABSTRACT

A method for setting a gem stone in a semi-precious stone, capable of achieving an easy setting and thereby greatly reducing the labor and the work time. The method includes the steps of preparing a gem stone having a girdle and upper and lower tapered surfaces disposed above and beneath the girdle, preparing a semi-precious stone including an upper semi-precious stone piece having a hole provided with an upwardly-tapered contact surface having the same taper angle as the upper tapered surface of the gem stone and a lower semi-precious stone piece having a hole provided with a downwardly-tapered contact surface having the same taper angle as the upper tapered surface of the gem stone, fitting the gem stone in the hole of the lower semi-precious stone piece such that the lower tapered surface thereof is in contact with the contact surface of the lower semi-precious stone piece, and bonding the upper semi-precious stone piece to the lower semi-precious stone piece such that the contact surface of the upper semi-precious stone piece is in contact with the upper tapered surface of the gem stone.

2 Claims, 3 Drawing Sheets

METHOD FOR SETTING GEM STONE IN SEMI-PRECIOUS STONE

BACKGROUND OF THE INVENTION

1. Field of the Invention

The present invention relates to a method for setting accessaries such as rings and ear rings with gem stones and semi-precious stones.

2. Description of the Prior Art

In many cases, gem stones such as diamond, ruby, sapphire and the like are set in a background of semi-precious stones such as onyx, cubic zirconia stone, turkey stone, lapis stone and the like so as to provide accessaries with better ornamental beauty.

In order to set a gem stone such as a diamond in a background of semi-precious stone, a soft metal member has always been used as a setting member for the gem stone and the semi-precious stone.

FIGS. 1 and 2 illustrate a conventional method using such a soft metal member for setting a gem stone in a semi-precious stone. As shown in FIGS. 1 and 2, a gem stone 10 is machined to have upper and lower tapered surfaces disposed above and beneath a girdle 11. A semi-precious stone 20 having a plate shape is also provided. The semi-precious stone 20 is machined to have a central hole 21. A ring member 30 made of soft metal is also provided for setting the gem stone 10 in the semi-precious stone 20. The metal ring member 30 is firmly fitted in the central hole 21 of the semi-precious stone 20. The metal ring member 30 is provided with a plurality of coupling protrusions 31 each having a downwardly extending pin shape.

Upon setting the gem stone 10 in the semi-precious stone 20, part of the coupling protrusions 31 of the metal ring member 30 is inwardly bent, thereby enabling the gem stone 10 to be seated thereon. The metal ring member 30 with the gem stone 10 seated is then fitted in the central hole 21 of the semi-precious stone 20. Thereafter, the upper rim of the metal ring member 30 is pressed down such that it is radially inwardly spread, thereby enabling the gem stone 10 to be set in the semi-precious stone 20. Thus, the gem stone 10 is set in the semi-precious stone 20.

Because of using complicated and difficult works, the conventional method requires a lot of time and labor. Furthermore, the conventional method has a drawback of deterioration in ornamental beauty of the gem stone because the metal is always interposed between the gem stone and the semi-precious stone.

SUMMARY OF THE INVENTION

Therefore, an object of the invention is to eliminate the above-mentioned drawbacks involved in the prior art and to provide a method for setting a gem stone in a semi-precious stone, capable of achieving an easy setting, thereby greatly reducing the labor and the work time.

In accordance with the present invention, this object can be accomplished by providing a method for setting a gem stone in a semi-precious stone, comprising the steps of: preparing a gem stone having a girdle, and upper and lower tapered surfaces disposed above and beneath the girdle; preparing a semi-precious stone including an upper semi-precious stone piece having a hole provided with an upwardly-tapered contact surface having the same taper angle as the upper tapered surface of the gem stone and a lower semi-precious stone piece having a hole provided with a downwardly-tapered contact surface having the same taper angle as the upper tapered surface of the gem stone; fitting the gem stone in the hole of the lower semi-precious stone piece such that the lower tapered surface thereof is in contact with the contact surface of the lower semi-precious stone piece; and bonding the upper semi-precious stone piece to the lower semi-precious stone piece such that the contact surface of the upper semi-precious stone piece is in contact with the upper tapered surface of the gem stone.

BRIEF DESCRIPTION OF THE DRAWINGS

These and other objects, features and advantages of the invention will become more apparent upon reading the following detailed specification and drawings, in which:

FIGS. 5A to 5C are sectional views respectively illustrating sequential setting steps of the method of the present invention, in which FIG. 5A shows a step of seating the gem stone in a lower semi-precious stone piece, FIG. 5B shows a step of applying an adhesive to the lower semi-precious stone piece, and FIG. 5C shows a step of bonding an upper semi-precious stone piece to the lower semi-precious stone piece.

DETAILED DESCRIPTION OF THE PREFERRED EMBODIMENT

Figure 1:
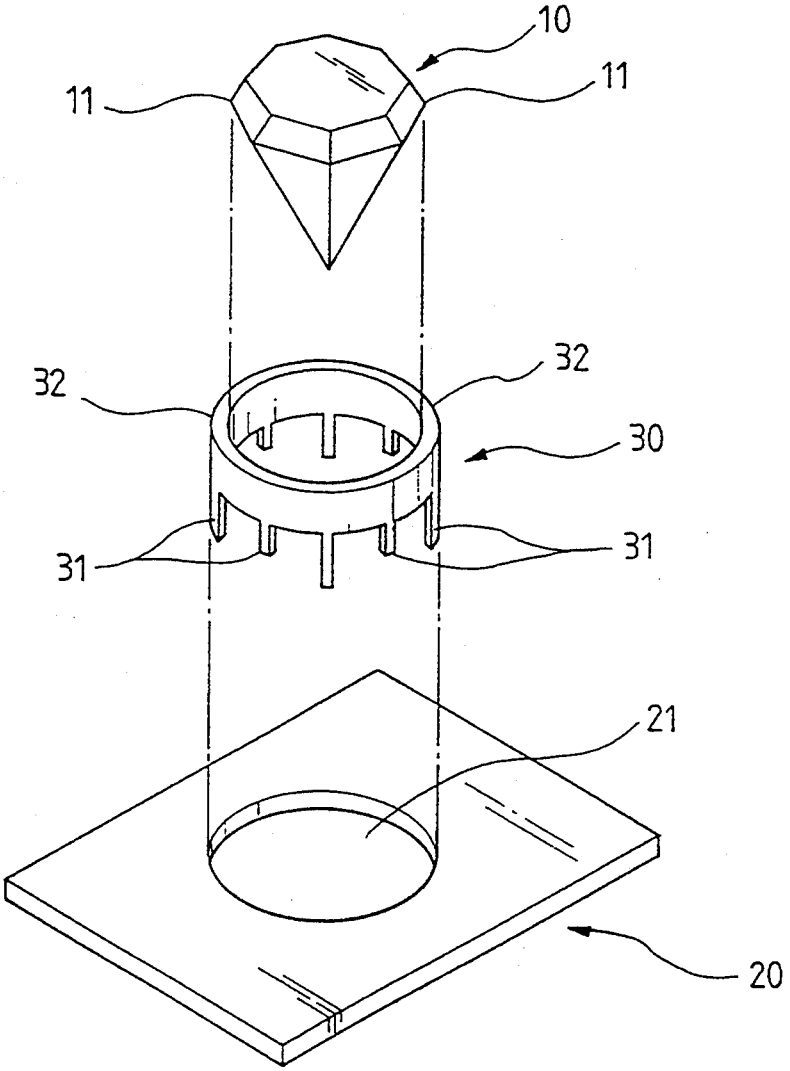
Fig. 1 PRIOR ART
FIG. 1 is an exploded perspective view illustrating a conventional method for setting a gem stone in a semi-precious stone.
Figure 2:
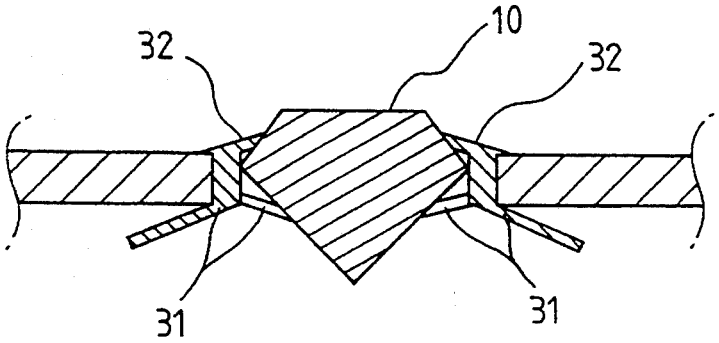
Fig. 2 PRIOR ART
FIG. 2 is a sectional view illustrating a condition that the gem stone is set in the semi-precious stone in accordance with the conventional method.
Figure 3:
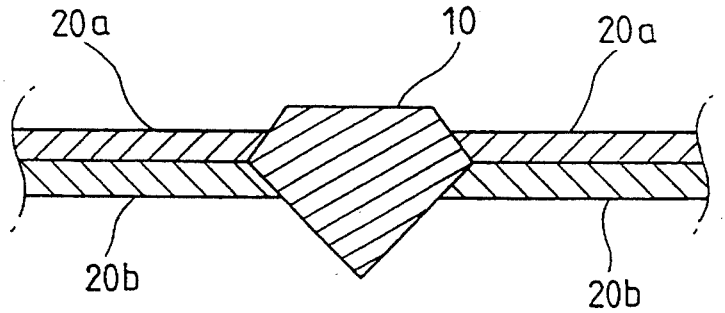
FIG. 3 is a sectional view illustrating a method for setting a gem stone in a semi-precious stone in accordance with the present invention, the gem stone being shown as set in the semi-precious stone.
Figure 4:
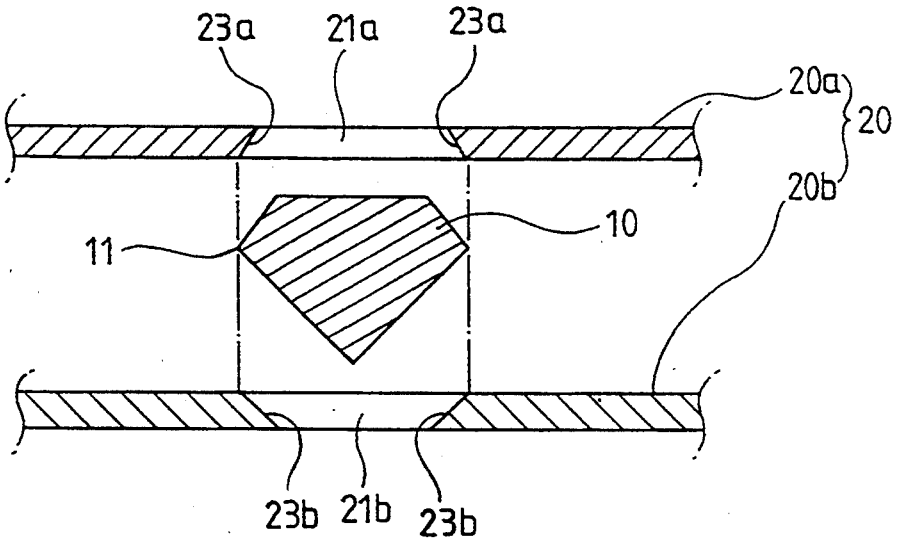
FIG. 4 is an exploded sectional view illustrating the method of the present invention.

FIGS. 3 and 4 illustrate a method for setting a gem stone in a semi-precious stone in accordance with the present invention. In FIGS. 3 and 4, elements corresponding to those in FIGS. 1 and 2 are denoted by the same reference numerals.

In accordance with the present invention, a gem stone 10 is machined to have upper and lower tapered surfaces disposed above and beneath a girdle 11. A semi-precious stone 20 is provided which comprises an upper semi-precious stone piece **20*a* and a lower semi-precious stone piece 20*b*. As shown in FIG. 4, the upper semi-precious stone piece 20*a* is machined to have a hole 21*a* having an upwardly-tapered contact surface 23*a*. The tapered contact surface 23*a* has the same taper angle as the upper tapered surface of the gem stone 10. Similar to the upper semi-precious stone piece 20*a*, the lower semi-precious stone piece 20*b* is machined to have a hole 21*b* having a downwardly-tapered contact surface 23*b*. The tapered contact surface 23*b* has the same taper angle as the lower tapered surface of the gem stone 10. With this construction, the gem stone 10 can be set in the semi-precious stone 20 by fitting the gem stone 10 in the holes 21*a* and 21*b* of semi-precious stone pieces 20*a* and 20*b*, and then bonding the semi-precious stone pieces 20*a* and 20*b*** to each other.

Now, the procedures for setting the gem stone 10 in the semi-precious stone 20 in accordance with the present invention will be described in detail, in conjunction with FIGS. 5A to 5C.

Figure 5A:
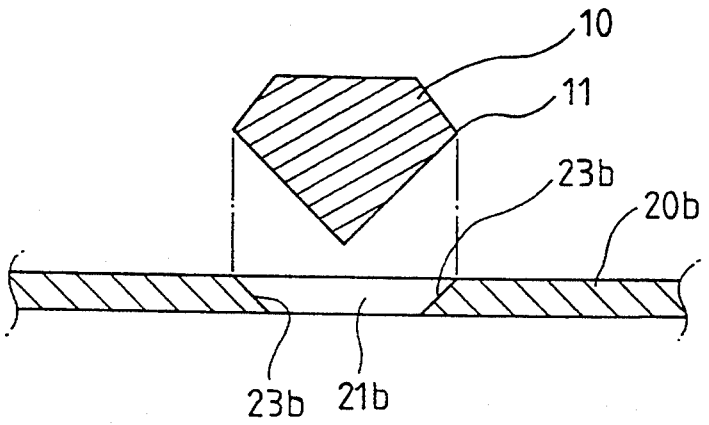
Figure 5B:
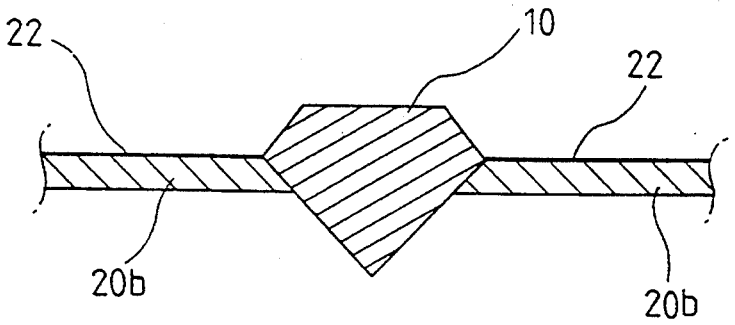
Figure 5C:
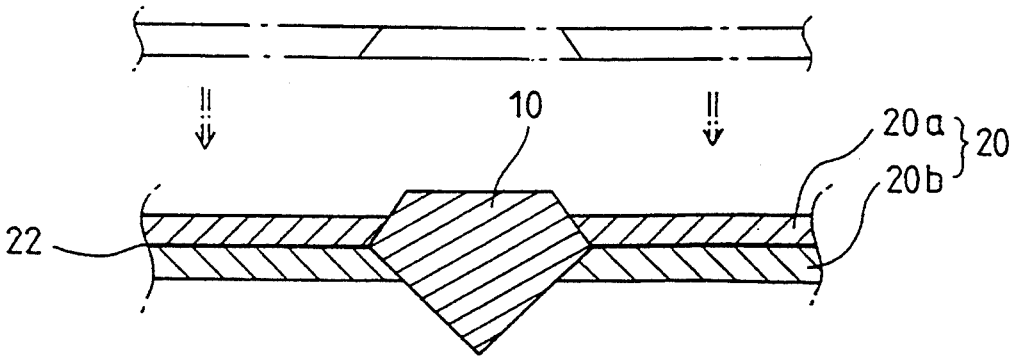

At the first step shown in FIG. 5A, the gem stone 10 is fitted in the hole 21*b* of the lower semi-precious stone piece 20*b* such that the lower tapered surface thereof comes into contact with the contact surface 23*b* of lower semi-precious stone piece 20*b*. As the lower tapered surface of the gem stone 10 comes into contact with the contact surface 23*b* of the lower semi-precious stone piece 20*b*, the gem stone 10 is stably seated on the lower semi-precious stone piece 20*b*. Thereafter, an adhesive 22 is coated on the upper surface of semi-precious stone piece 20*b* at the second step shown in FIG. 5B. Under this condition, the upper semi-precious stone piece 20*a* is seated on the lower semi-precious stone piece 20*b* such that the contact surface 23*a* thereof comes into contact with the upper tapered surface of the gem stone 10. Subsequently, the upper and lower semi-precious stone pieces 20*a* and 20*b* are bonded to each other. Thus the setting of the gem stone 10 in the semi-precious stone 20 is completed.

As apparent from the above description, the present invention provides a method for setting a gem stone in a semi-precious stone having a construction capable of directly setting the gem stone therein without using any metal setting member. In particular, the semi-precious stone is constituted by upper and lower semi-precious stone pieces enabling mass production. Therefore, the method of the present invention can reduce the labor and work time required in setting of the gem stone, as compared with the conventional gem stone setting method requiring manual works. Since the method of the present invention eliminates the use of the metal setting member required in the conventional method, the ornamental beauty of a gem stone is more enhanced.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A method for setting a gem stone in a semi-precious stone, comprising the steps of:

preparing a gem stone having a girdle and upper and lower tapered surfaces disposed above and beneath the girdle;

preparing a semi-precious stone including an upper semi-precious stone piece having a hole provided with an upwardly-tapered contact surface having the same taper angle as the upper tapered surface of the gem stone and a lower semi-precious stone piece having a hole provided with a downwardly-tapered contact surface having the same taper angle as the upper tapered surface of the gem stone;

fitting the gem stone in the hole of the lower semi-precious stone piece such that the lower tapered surface thereof is in contact with the contact surface of the lower semi-precious stone piece; and bonding the upper semi-precious stone piece to the lower semi-precious stone piece such that the contact surface of the upper semi-precious stone piece is in contact with the upper tapered surface of the gem stone.

2. A method for setting a gem stone in a semi-precious stone according to claim 1, wherein said upper and lower tapered surfaces converge to each end so that the diameter of the middle portion is larger than that of each end of the gem stone.

* * * * *